US005394821A

United States Patent [19]

Ziegler et al.

[11] Patent Number: 5,394,821

[45] Date of Patent: Mar. 7, 1995

[54] PROTECTIVE COVERING FOR WATERCRAFT

[76] Inventors: Stephen R. Ziegler, both of 25533 Svyvesant St., Moreno Valley, Calif. 92557; Mark A. Winans, both of Moreno valley

[21] Appl. No.: 114,916

[22] Filed: Aug. 31, 1993

[51] Int. Cl.[6] ..... B63B 59/02

[52] U.S. Cl. ..... 114/219; 114/361

[58] Field of Search ..... 114/361, 343, 364, 219; 150/166

[56] References Cited

U.S. PATENT DOCUMENTS

| | | | |
|---|---|---|---|
| 3,354,892 | 11/1967 | Frieder | 114/361 |
| 3,399,687 | 9/1868 | Frieder | 114/361 |
| 3,698,409 | 10/1972 | Koontz et al. | 114/361 |
| 4,612,967 | 9/1986 | Kaman et al. | 150/166 |
| 5,228,408 | 7/1993 | Jannausch | 114/361 |

*Primary Examiner*—Edwin L. Swinehart

*Attorney, Agent, or Firm*—J. E. Brunton

[57] ABSTRACT

A protective covering of a watercraft which is constructed of a thin, stretchable material that completely circumscribes the upper portion of the hull of the craft thereby protecting it from the elements and from damage from other watercraft and fixed objects such as boat docks. The protective covering is formed from a plurality of easily interconnected segments that can be compactly rolled or folded for ease of storage and transport. The covering is sleek and attractive, is light weight, floatable, durable in use, resists tearing and abrasion and effectively protects the craft from scratches, dings and dents when the craft comes into contact with other watercraft or with fixed objects.

16 Claims, 5 Drawing Sheets

48a
46c
C 49
49a 48b
48b
40
C
48
56
V
56a
V
46a
46c
V
46c
V
46
40
26c
31
26d
C

48a
V
40
48
C
V
V
48a
46c
46b
46a
C
V
V
46

PROTECTIVE COVERING FOR WATERCRAFT

BACKGROUND OF THE INVENTION

1. Field of the Invention

The present invention relates generally to protective coverings for watercraft. More particularly, the invention concerns an easily installable protective covering which circumscribes the upper portion of the hull of a watercraft to protect it from physical damage from fixed objects and other watercraft.

2. Discussion of the Invention

Today's boats are far more sophisticated and considerably more costly than ever before. Many have a sleek, attractive appearance and require constant care to maintain that appearance. Because of the pride of ownership shared by most watercraft enthusiasts, the need for more adequate protective coverings for watercraft has become increasingly more desirable.

Various types of devices for protecting the hulls of watercraft from damage have been suggested in the past. Typically these prior art devices are in the nature of boat fenders or bumpers which are placed over the outside of the watercraft and are intended to be positioned between the hull and a boat deck or like structure. These devices are usually cylindrical in shape and are formed of a soft rubber. Some prior art bumpers include an inflatable bladder which can be filled with air. Exemplary of such prior art fender-type devices are those described in U.S. Pat. No. 4,351,257 issued to Brown and in U.S. Pat. No. 4,664,053 issues to Mesinger.

A device of somewhat more sophisticated design is described in U.S. Pat. No. 4,915,662 issued to Kent. This device comprises a combination marine fender and cushion and is formed by a foldable pliable sheet which is provided with a plurality of spaced-apart cushioning pads. The Kent patent also contains an excellent review of the prior art which preceded it and identifies and discusses several early patents including U.S. Pat. Nos. 2,546,396; 3,026,547; 4,275,473; and 4,268,850.

Another prior art U.S. Pat. No. 4,970,980 issued to Eisner, discloses side protectors for watercraft which comprise a base which can be affixed to the hull of the craft and into which an inflatable bladder can be inserted.

A drawback of many of the prior art devices is that they only cover and protect a very small portion of the boat hull. Further, they are usually bulky, difficult to install, and often substantially detract from the appearance of the boat.

The device of the present invention represents a significant improvement over the prior art devices in that it comprises a protective covering which circumscribes the entire upper portion of the hull of the watercraft and includes additional, easy-to-use fastening means for securely fastening the device to the boat railings, tie-downs, and other hull surfaces, if desired. The device comprises a plurality of easily interconnectable sections including a bow section which fits about the bow of the craft, side sections which are connected to the end of the bow section and stern sections which are connectable to the side sections. The stern sections neatly fold around the stern of the craft, and are interconnected together in a manner to maintain the device snugly in position about the upper portion of the hull. When not in use, the light weight and compact cooperating sections of the device can be readily disconnected from the boat and folded for easy storage and transport. Each section can be individually removed and rolled up, or the sections can be left attached to one another, and easily rolled up (like a sleeping bag) for storage.

SUMMARY OF THE INVENTION

It is an object of the present invention to provide a protective covering for a watercraft that effectively enables the watercraft enthusiast to protect his craft from damage while maintaining a sophisticated, "designer" appearance for the watercraft. The easily installable covering completely circumscribes the upper portion of the hull of the craft, thereby protecting it from damage from other watercraft and fixed objects such as boat docks.

Another object of the invention is to provide a protective covering of the aforementioned character which eliminates the inconvenience of continually tying and repositioning bumper buoys and one which can be quickly and easily connected to and removed from the hull of the craft without the need for special tools of any kind.

Another object of the invention is to provide a device of the type described in the preceding paragraphs which is formed from a plurality of easily interconnected, thin, flexible, polymer segments such as polychloroprene-, that can be made in various sizes and thicknesses to fit different types of watercraft and can be compactly rolled or folded when not in use for ease of storage and transport.

Still another object of the invention is to provide a protective covering of the class described which is light weight, durable in use, resists tearing and abrasion, can be constructed in various thicknesses, is soft so as not to scratch the watercraft surface and effectively protects the craft from ultraviolet rays, saltwater, oil and chemicals. The covering is strategically positioned so as to also protect against scratches, dings and dents when the craft comes into contact with other watercraft or with fixed objects.

Yet another object of the invention is to provide a covering of the aforementioned character which closely conforms to the hull of the watercraft craft during use, is very sleek and attractive and yet can be inexpensively manufactured in quantity. The covering can be constructed in various colors to match the colors of the watercraft, is highly decorative and can be personalized in several ways to suit the desires of the watercraft owner.

DESCRIPTION OF THE INVENTION

Figure 1:
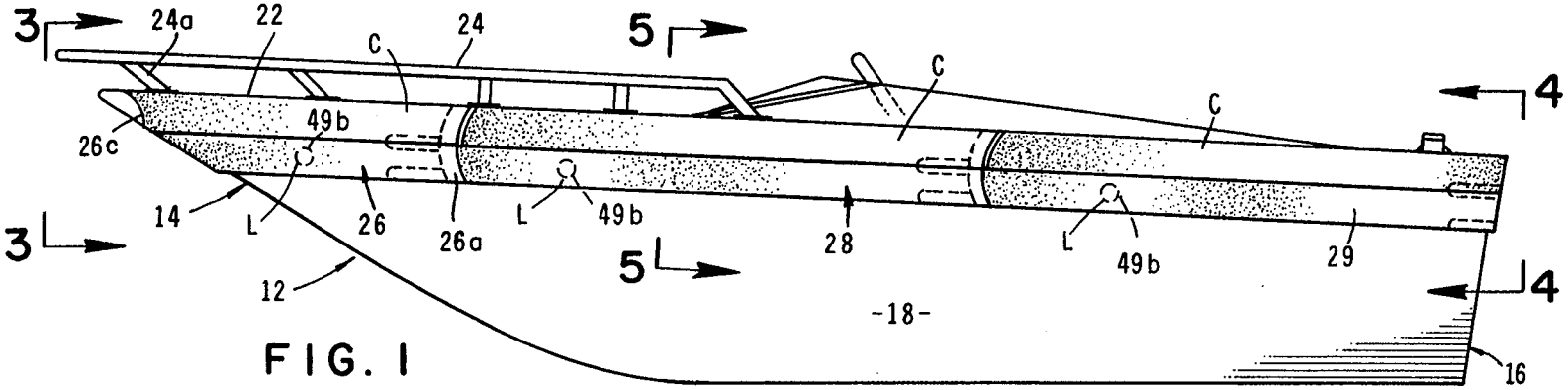
FIG. 1 is a side-elevational view of a watercraft to which the protective cover of the present invention has been affixed.

Referring to the drawings and particularly to FIGS. 1 through 5, one form of the protective covering for watercraft of the present invention is there illustrated. The protective covering of this form of the invention is adapted to be used with a watercraft such as a sport boat 12, of the character having a bow portion 14, a stern portion 16, first and second side walls 18 and 20 respectively, a deck portion 22 and a boat rail 24 which is affixed to deck 22.

In the preferred form of the invention, the protective covering is constructed of a plurality of releasably interconnected sections which are easily separated and preferably formed of a stretchable polymer material such as polychloroprene (sold under the trademark NEOPRENE ®, alone or in conjunction with NEOPRENE laminated fabric Lycra and four-way stretch nylon. In the embodiment of the invention shown in FIGS. 1 through 5, the protective covering comprises a bow section 26, which is closely fitted about the bow portion of the watercraft, first and second side sections 28 and 30, which are releasably interconnected to bow section 28 and cover the forward portions of the sides of the watercraft, third and fourth side sections 29 and 31 which cover the rearward portions of the sides of the watercraft and first and second stern sections 32 and 34 which cover portions of the stern of the watercraft. Stern sections 32 and 34 are releasably interconnected with side sections 29 and 31 in a manner presently to be described.

Figure 4:
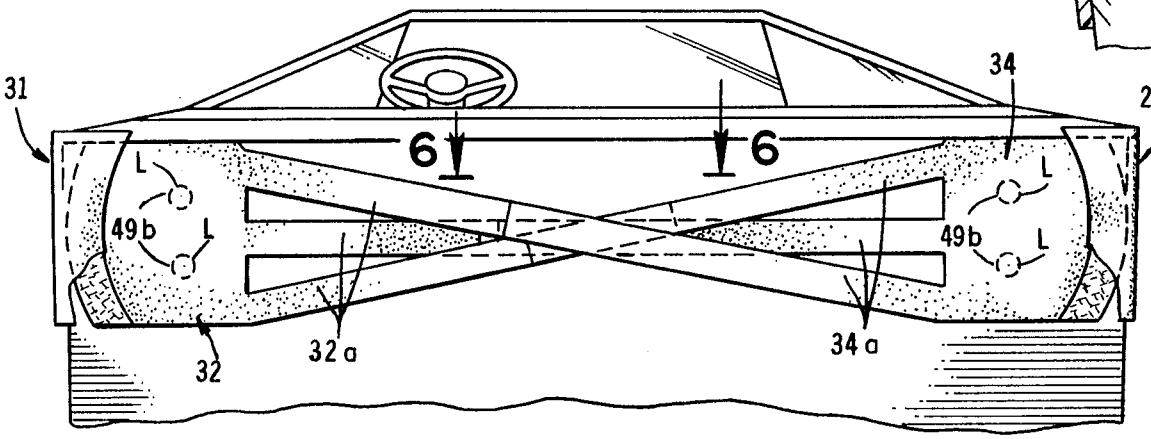
FIG. 4 is a rear view of the watercraft and protective cover taken along lines 4—4 of FIG. 1 illustrating the manner of interconnection of the stern segments of the protective cover.

As best seen by referring to FIG. 4, each of the stern sections, 32 and 34, is provided with a plurality of outwardly extending finger-like straps **32*a* and 34*a* respectively which are adapted to be interconnected in a straight or crossing fashion illustrated in FIG. 4. The method of interconnection of fingers 32*a* and 34*a*** will presently be described.

Figures 7, 8, 9, 10, 11, 13:
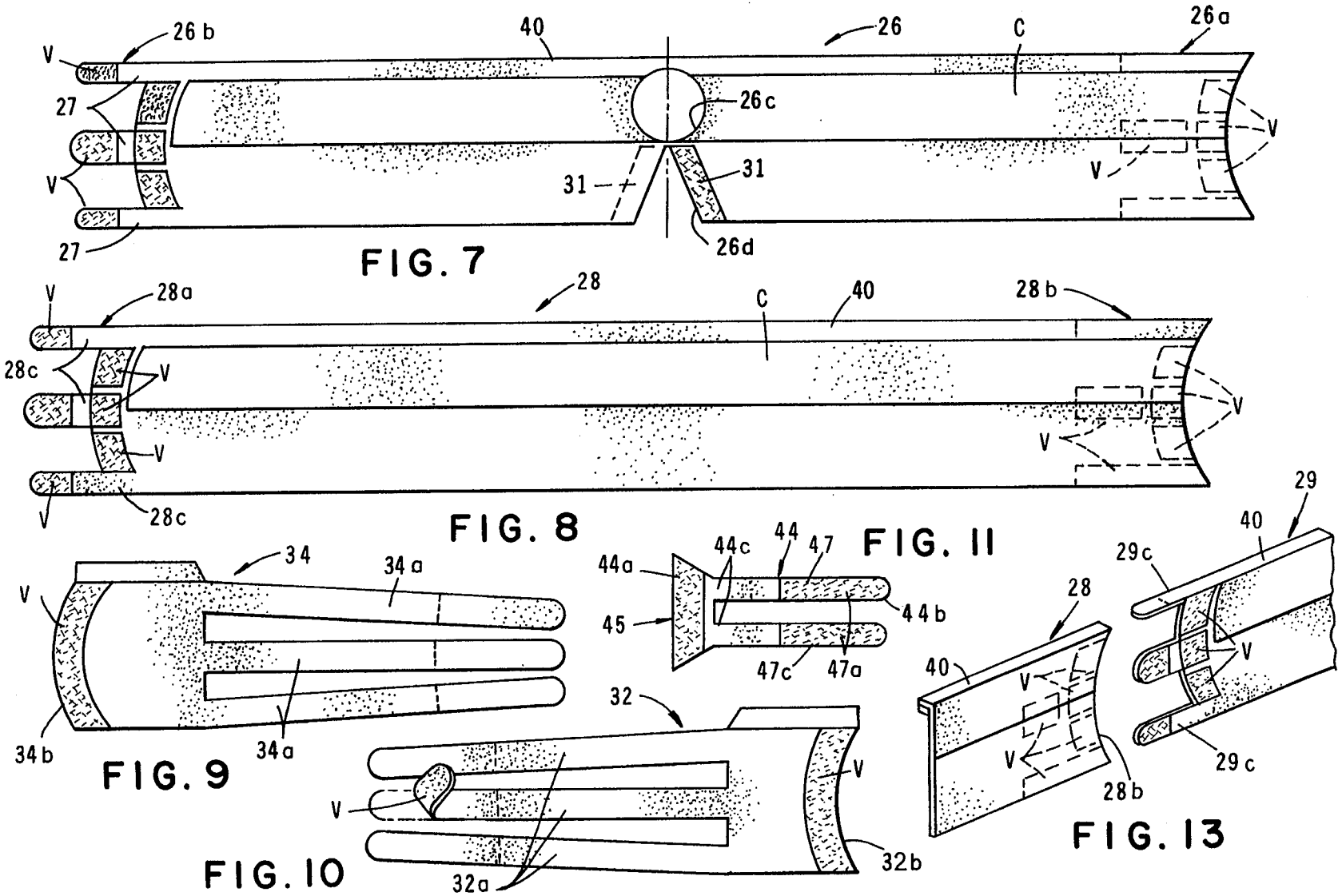
FIG. 7 is a front view of the bow section of the protective cover.
FIG. 8 is a side view of one of the side section of the protective cover.
FIG. 9 is a plan view of one of the stern sections of the protective cover.
FIG. 10 is a plan view of the other of the stern sections of the protective cover.
FIG. 11 is a plan view of one of the connector members used to connect the protective cover to the boat railing.
FIG. 13 is a generally perspective, fragmentary view illustrating the manner of interconnection of two selected sections of the protective cover.

Referring particularly to FIG. 7, bow section 26 is provided with first and second ends **26*a* and 26*b* respectively. End 26*b* is, in turn, provided with a plurality of outwardly extending finger like connector portions 27 each of which terminates in curved extremities and each of which carries fastening means or connector elements "V" which are here shown as small strips of connector material sold under the trademark VELCRO ®. This material, which is well known in the art, includes on one part a multiplicity of hooks and on the other mating part a multiplicity of loops. Provided on the undersurface of concave end 26*a* of bow section 26 are a plurality of VELCRO connectors "V" (see dotted lines in FIG. 7**).

Figure 3:
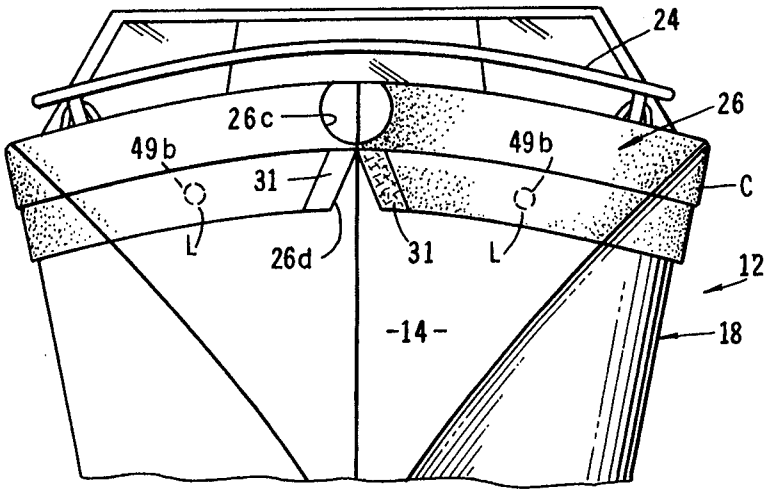
FIG. 3 is a front view of the watercraft and protective cover taken along lines 3—3 of FIG. 1.

Bow section 26 is also provided with a centrally disposed aperture **26*c* which receives the point of the bow and includes snugging means for foreshortening the bow section so as to urge it into close engagement with the side walls of the watercraft after the covering has been initially emplaced over the watercraft. This snugging or foreshortening means is here shown in the form of mateable segments 31 of VELCRO ® which are affixed proximate the marginal edges of a "V" shaped interruption 26*d* formed proximate the center of bow section 26 (FIGS. 3 and 7**).

Figure 12:
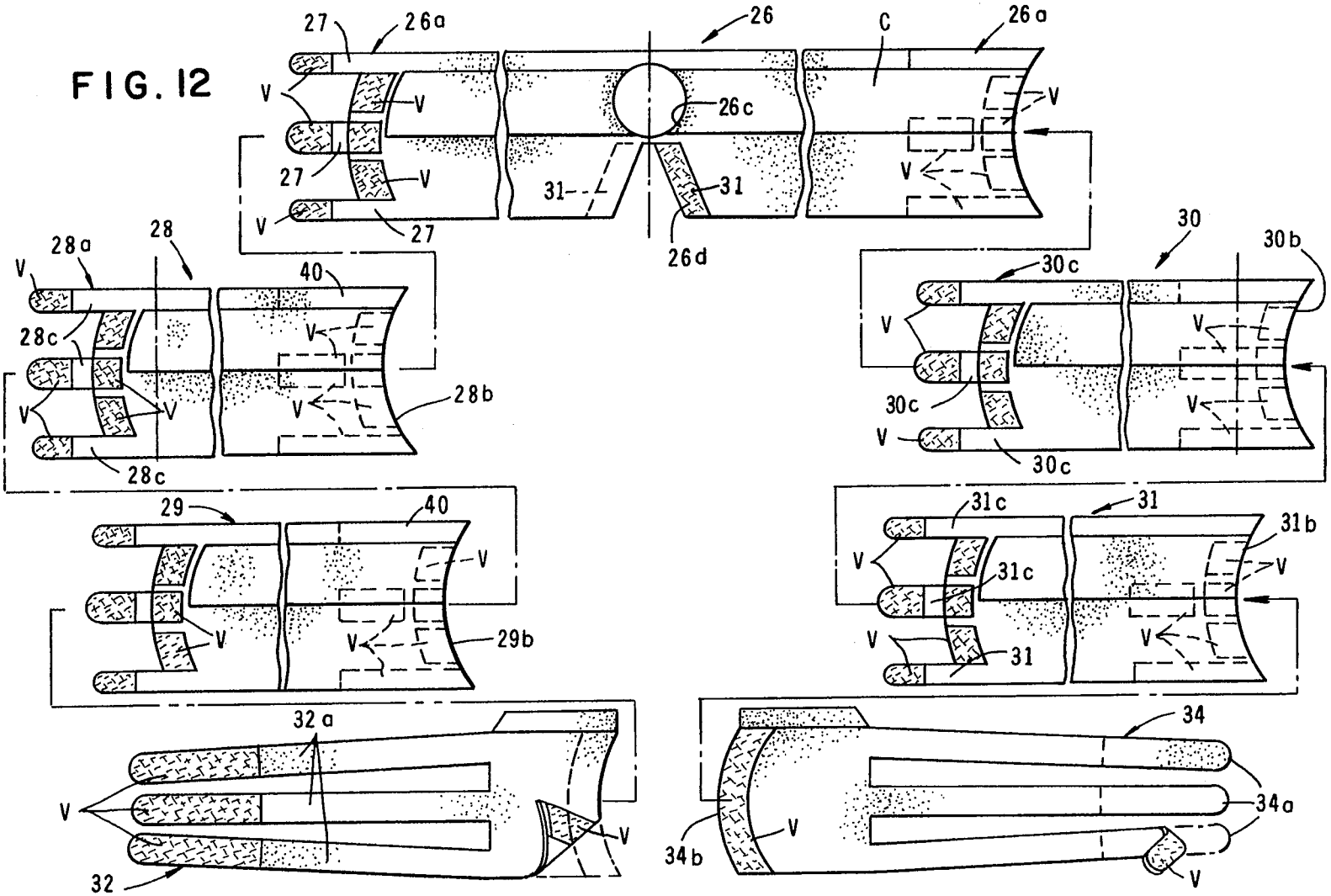
FIG. 12 is a foreshortened, generally exploded, diagrammatic view illustrating the manner of interconnection of the various sections of the protective cover.

Turning now to FIG. 8, side section 28 is there shown in enlarged form and can be seen to comprise first and second ends **28*a* and 28*b* respectively. End 28*a* is provided with a plurality of outwardly extending fingers 28*c* that terminate in curved extremities. Each finger 28*c* is provided with connector elements "V" which once again may comprise segments of VELCRO or like material. Similarly, segments of VELCRO material are attached to the underside of section 28 proximate end 28*b* (see dotted lines in FIG. 8). As indicated in FIG. 12, side sections 29, 30 and 31 are of similar construction to section 28**.

Referring now to FIGS. 9 and 10, stern sections 32 and 34 are there shown in slightly enlarged form. Stern section 32 is provided with a convex end portion **32*b* which carries a connector element "V" also preferably formed of a VELCRO material. Similarly, stern section 34 includes a concave end portion 34*b*** which also carries a connector element "V" constructed of a VELCRO material.

Figure 6:
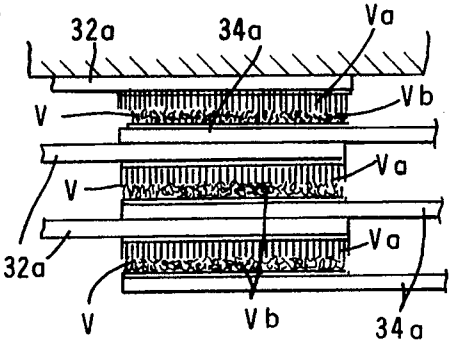
FIG. 6 is an enlarged, fragmentary view taken along lines 6—6 of FIG. 4.

As best seen by referring to FIG. 6, each of the finger or strap-like portions **32*a* and 34*a* of the stern sections is provided with connector elements "V" which once again preferably comprise a VELCRO-like material. The portion designated in FIG. 6 as "Va" exhibits a multiplicity of hook-like members while the portions designated as "Vb" exhibit a plurality of loop-like members. As indicated in FIGS. 4 and 6, when fingers 32*a* and 34*a*** are overlapped in the manner shown in these figure drawings, the second end portions of the stern sections can be securely interconnected together in a straight or crossing fashion so as to retain the protective covering snugly about the hull of the watercraft.

Figure 5:
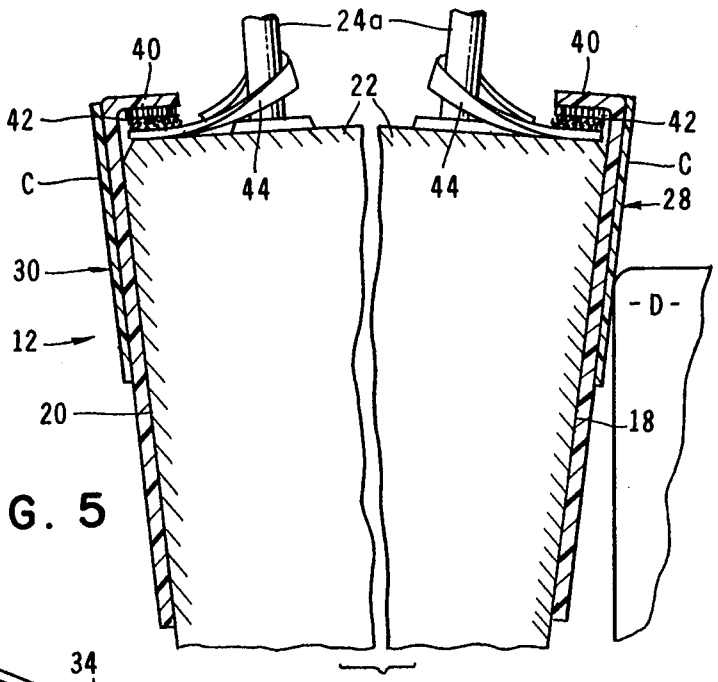
FIG. 5 is a foreshortened, fragmentary view of the watercraft and cover taken along lines 5—5 of FIG. 1 illustrating the manner of attachment of the upper portions of the cover to connector members which are, in turn, adapted to be connected to the boat railing.

Turning now particularly to FIG. 5, it is to be noted that side sections 28 and 30 are each provided with upper, deck overlap portions segment 40 which are adapted to overlie the margins of deck 22 in the manner shown in FIG. 5. Side sections 29 and 31 also have comparable deck overlap portions. Fastening means, shown here as comprising VELCRO strips 42, are interconnected to the undersurface of portions 40 at longitudinally spaced locations. The interconnection means for releasably interconnecting the bow and side sections to the boat rail 24 further comprises a straps of the character best seen in FIGS. 5 and 11. These elongated straps 44 made of NEOPRENE® or nylon, include a first generally triangularly shaped end 44*a*, which is provided with a connector element or VELCRO strip 45, and a second curved end 44*b*, which is also provided with a connector element of VELCRO strip 47. In using the interconnection means, each end 45 of each strap 44 is first releasably interconnected with a selected connector element 42 provided on the underside of deck overlap portions 40. Next, the elongated body portion 44*c* of each strap or connector member 44 is wrapped around an adjacent deck post 24*a* in the manner shown in FIG. 5 and then looped back on itself so that the portion 47*a* of the connector element can be releasably interconnected with the central portion 47*c* of the connector element.

Figure 2:
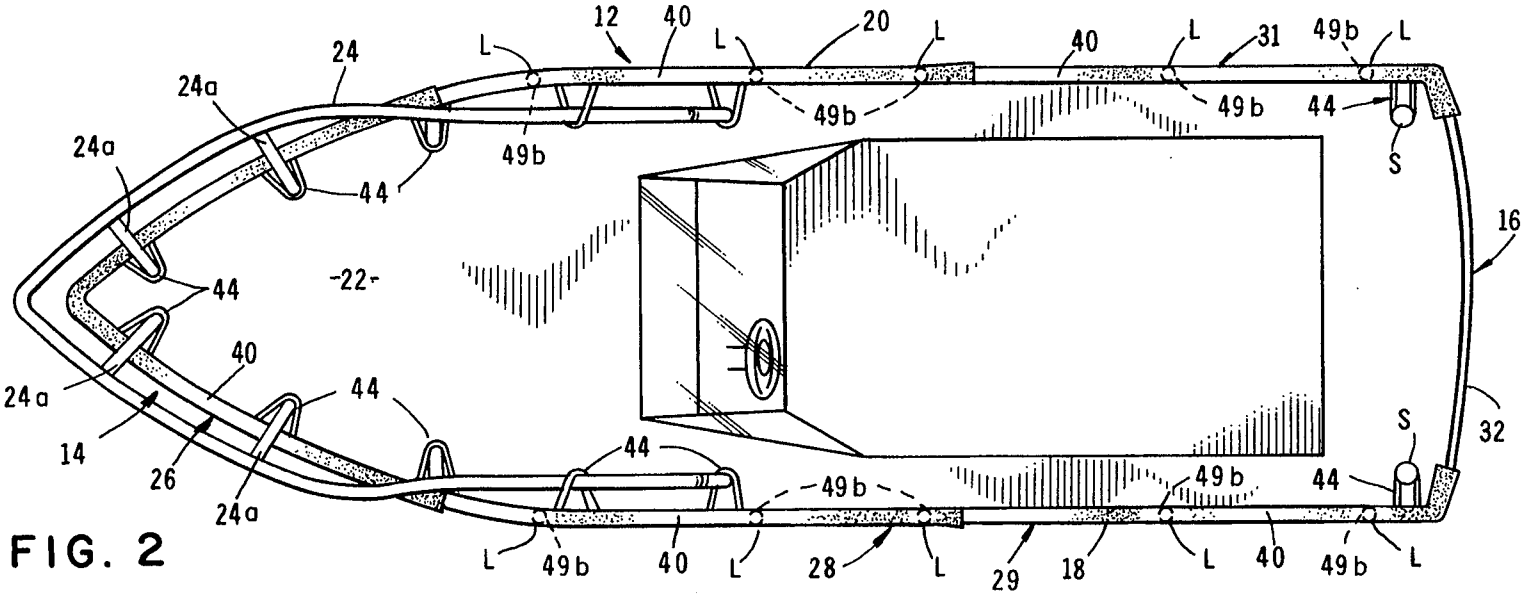
FIG. 2 is a top plan view of the watercraft and protective cover.

As best seen in FIG. 2, by using several straps 44, the bow and side sections 28 and 30 of the protective cover can be positively secured to the boat railing 24 at a number of locations. Proximate the stern of the boat, connector means in the form of small suction cup assemblies "S" attached to NEOPRENE straps, are removably affixed to the deck for use in connection with straps 44 to secure any section, but typically side sections 29 and 31, to the rear deck of the watercraft.

Turning next to FIGS. 12 and 13, it is to be noted that side sections 28 and 29 are of similar construction as are side sections 29 and 30. More particularly, side sections 28 and 29 are both provided at one end with a plurality of fingers 28*c* and 29*c*) which carry connector elements "V". The opposite end of the side sections are concave and carry on their undersurfaces a plurality of connector elements "V". In similar fashion, side sections 30 and 31 are of similar construction with each having at one end a plurality of outwardly extending fingers (30*c* and 31*c*) each of which carries a connector element "V". The opposite ends sections 30 and 31 are concave in shape and carry on their undersurfaces a plurality of connector elements "V".

In using the apparatus of the invention as thus described, the bow section 26 of the protective cover is first positioned about the bow of the watercraft in the manner shown in FIG. 1. Next side section 28 is connected to the bow section by placing the concave end 28*b* thereof over end portion 26*b* of the bow section so that the connector elements "V" provided on each section mateably engage. Side section 30 is similarly mated with the bow section 26 by overlaying the concave end 26*a* of the bow section over fingers 30*c* of side section 30 so that the connector elements or VELCRO strips "V" mateably interconnect.

After side sections 28 and 30 have been interconnected with bow section 26, side sections 29 and 31 are interconnected with side sections 28 and 30 respectively by overlaying the end portions thereof in the manner illustrated in FIG. 12 (see also FIG. 13). After the side sections have been interconnected, the concave end portion 32*b* of stern section 32 is laid over fingers 29*c* of side section 29 so that the VELCRO elements "V" provided on these section are brought into mateable engagement. In similar fashion, the concave end portion 31*b* of side section 31 is placed over the convex end portion 34*b* of stern section 34 so that the VELCRO connector elements provided on these sections are brought into mating engagement.

With the various sections of the cover thereby interconnected fingers 32*a* and 34*a* of the stern sections are pulled rearwardly of the craft to snug the bow and side protective sections tightly about the upper circumference of the boat hull. The fingers of the stern sections are overlayed in the crossing configuration shown in FIG. 2 so that the VELCRO elements provided on the ends of the fingers or straps move into mating engagement thereby holding the protective covering snugly about the upper portion of the hull of the watercraft in the manner illustrated in FIGS. 1, 2 and 4. With the protective cover thus snugly positioned about the watercraft hull, connector members or straps 44 are next interconnected with the protective cover and then with the watercraft rail in the manner previously described herein. Similarly, suction cup assemblies "S" are affixed to the rear deck and straps 44 are connected to side section 29 and 31 and to assemblies "S" in a manner to secure these sections to the deck. It is to be understood that additional suction cup assemblies may be used as necessary at any location on the deck.

Figures 13A, 14, 15, 16:
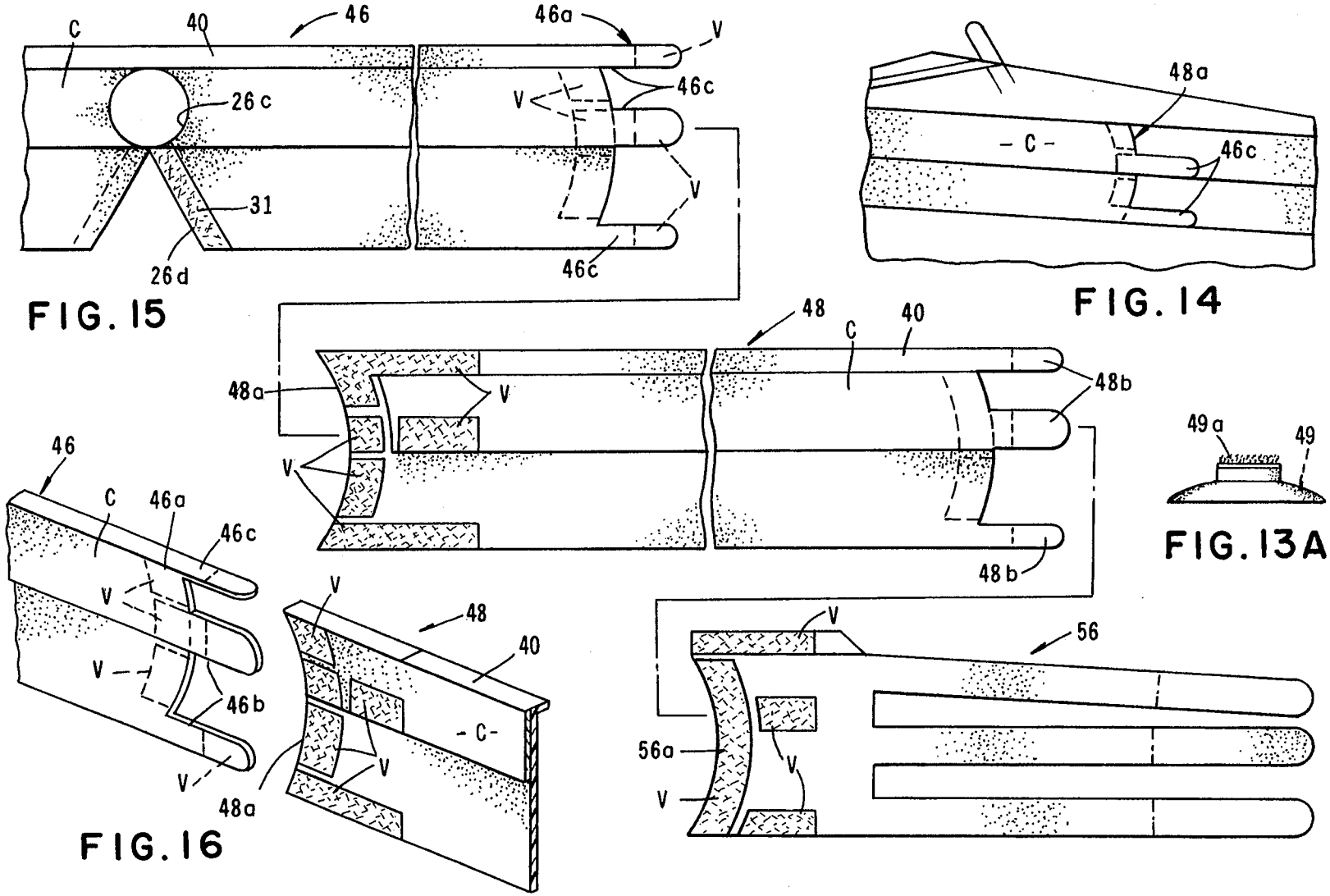
FIG. 13A is a side elevational view of an additional suction cup type fastener for use in connecting the protective covering to the hull of the watercraft in selected locations.
FIG. 14 is a fragmentary side view of the watercraft and protective covering of an alternate form of the invention.
FIG. 15 is a fragmentary, exploded, diagrammatic view of an alternate form of bow section, side section and stern section illustrating the manner of their interconnection.
FIG. 16 is a generally perspective, fragmentary view illustrating the manner of interconnection of two selected sections of the alternate form of protective covering of the invention.

As shown in FIG. 13A, specially designed suction cup assemblies 49 can also be used to secure the protective cover to the watercraft hull at selected locations L, such as those designated by the dotted lines in FIGS. 1, 2, 3 and 4. These additional fastening means or suction cup assemblies 49 include VELCRO caps 49*a* which adhere to small strips of VELCRO 49*b* which can be affixed as by adhesives to the under surface of the protective covering at the location L. After the caps are connected to the strips 49*b*, the suction cup is pressed against the hull or deck to secure the covering in position.

Turning now to FIGS. 14, 15 and 16, an alternate embodiment of the invention is there illustrated. This embodiment of the invention is similar in many respects to that described in the preceding paragraphs and like numbers are used to designate like components. However, in this latter form of the invention, the bow section is much longer than before and the right hand end portion 46*a* thereof rather than the left hand end portion is provided with a plurality of outwardly extending fingers 46*c*. Once again, each of these fingers is provided with connector elements or VELCRO strips "V". Side section 48 of this embodiment of the invention is also longer than before and includes a concave end portion 48*a* which is adapted to mate with end portion 46*a* of bow section 46 in the manner illustrated in FIGS. 14, 15 and 16. As indicated in the drawings, end portion 48 is provided with a plurality of connector elements or VELCRO strips "V" which mateably engage the VELCRO strips provided on the convex end of the bow section 46 and on fingers 46*c* thereof. As depicted in FIG. 14, when bow section 46 and side section 48 are interconnected and positioned about the watercraft hull, fingers 46*b* can then be superimposed over an end 48*a* of side section 48 so that they extend rearwardly, or toward the stern, of the watercraft. This positioning of fingers 46*b* may be advantageous over the earlier described embodiment for certain applications of the protective cover of the invention (see also FIG. 16 which further illustrates the interconnection of the sections of the cover in a manner such that the fingers extend rearwardly or to the stern of the watercraft and overlie the mating section of the protective cover).

As indicated in FIG. 14 and 15, the rear most side sections have been eliminated so that side sections 48 connect directly to the stern sections. The stern sections themselves are also of a slightly different configuration from that previously described. More particularly, stern section 56 of this latest form of the invention is provided with a concave end 56*a* which carries VELCRO strips that are configured to mate with the rear portion of side section 48 in a manner such that the fingers 48*b* provided on the right hand end of section 48 as viewed in FIG. 15 overlay the concave end portion 50*a* of stern section. 56. Once again, with this construction, the finger-like portions 48*b* of side section 48 overlap stern section and extend rearwardly of the watercraft.

In both the first and second embodiments of the invention as described herein, the cooperating sections can be of various lengths, widths and thicknesses to best accommodate the watercraft with which the device is to be used. For example, the side sections are preferably about seven to ten feet long and seventeen inches wide and have a thickness of about 3/16 inch to about ½ inch. Preferably a cushioning band "C" (FIG. 1) having a width of about eight inches, is sewn to the upper portion of each section of the covering to provide additional protection to the area of the watercraft that is subject to the most contact with the docks "D" and other fixed structures (FIG. 5). Cushioning band "C" can be constructed from various materials, and affixed in various ways, but materials sold by Rubatex Company under the name and style HYPALON and materials sold by GLOMEX, INC. have proven quite satisfactory. With the construction described, the protective covering is stretchable yet durable and will float if accidentally dropped into the water. Cushioning can also be added at other strategic locations as may be required.

The VELCRO connecting elements or strips can be of various sizes to meet particular needs, but are normally about three to four inches in length and about two to three inches wide. The connector elements are preferably sewn to the coupling sections and entire perimeter of each section is preferably hemmed for added strength and durability.

The protective covering can be of various colors and can incorporate various design features so as to have an attractive and pleasing appearance.

Having now described the invention in detail in accordance with the requirements of the patent statues, those skilled in this art will have no difficulty in making changes and modifications in the individual parts or their relative assembly in order to meet specific requirements or conditions. Such changes and modifications may be made without departing from the scope and spirit of the invention, as set forth in the following claims.

We claim:

1. A protective covering for a watercraft having a bow, a stern, side walls and a deck, said side walls having a height, said covering comprising:

(a) a bow portion having a width and being closely fitted about the bow and portions of the side walls and portions of the deck of the watercraft, said width of said bow portion being substantially less than the height of said side walls of the watercraft;

(b) first and second side portions connected to said bow portion and disposed in engagement with portions of the said walls of the watercraft said first and second side portions each having a width substantially less than the height of the walls of the watercraft;

(c) first and second stern portions having first and second end portions, said first portions being connected to said first and second side portions; and (d) means for interconnecting said second ends of said stern portions to maintain said bow portion and said side portions in snug engagement with the watercraft.

2. A covering as defined in claim 1, further including means for releasably interconnecting said first and second side portions to said bow portion.

3. A covering as defined in claim 2 in which said means for releasably interconnecting said first and second ends of said stern sections comprise a plurality of integrally formed interconnectable straps.

4. A covering as defined in claim 3 in which said watercraft includes a deck rail and in which said protective covering further includes connector means for connecting said bow portion and said first and second sade portions to said deck rail, said connector means comprising a plurality of elongated connector straps adapted to be connected to the deck rail.

5. A protective covering for a watercraft having a bow, a stern, side walls and a deck, said side walls having a height and said deck having a width, said covering comprising:

(a) a bow section closely fitted about the bow and portions of the side walls of the watercraft, said bow section having:

(i) an upper segment having a width and being engageable with the deck said width of said upper segment being substantially less than said width of said deck;

(ii) first and second ends;

(iii) a first connector element provided on said first end; and (iv) a second connector element provided on said second end;

(b) a first side section having a width and being connected to said first connector element of said bow section, said width of said first side section being substantially less than said height of said side walls of said watercraft, said first side section having an upper segment engagable with the deck, said upper segment having a width substantially less than said width of said deck of said watercraft;

(c) a second side section having a width and being connected to said second connector element of said bow section, said second side section having a width substantially corresponding to said width of said first side section, said second side section having an upper segment engagable with the deck, said upper segment of said second side section having a width substantially less than said width of said deck of said watercraft;

(d) a first stern section having first and second ends, said first end being connected to said first side section;

(e) a second stern section having first and second ends, said first end being connected to said second side section; and (f) means for releasably interconnecting together said second ends of said first and second stern section.

6. A covering as defined in claim 5 further including additional means for interconnecting said bow section, said stern section and said first and second side sections with the deck and hull of the watercraft.

7. A covering as defined in claim 5 in which said first side section includes a connector element adapted to be releasably connected to said first connector element of said bow section.

8. A covering as defined in claim 5 in which said second side section includes a connector element adapted to be releasably connected to said second connector element of said bow section.

9. A covering as defined in claim 5 further including means for releasably interconnecting said first and second stern sections with said first and second side sections respectively.

10. A covering as defined in claim 5 in which said bow section, said first and second side sections and said first and second stern sections are constructed from a stretchable neoprene material.

11. A covering as defined in claim 5 in which said second end of each of said first and second stern sections is provided with a plurality of elongated connecting fingers each having connector elements provided thereon.

12. A protective covering for a watercraft having a bow, a stern, side walls, a deck and a deck rail, said side walls having a height and said deck having a width, said covering comprising:

(a) a bow section having a width and being closely fitted about the bow and portions of the side walls of the watercraft, said bow section having a width substantially less than the height of said walls of said watercraft and including:
  (i) an upper segment engageable with the deck;
  (ii) first and second ends;
  (iii) a first connector element provided on said first end; and
  (iv) a second connector element provided on said second end;

(b) means for connecting said bow section to the deck rail;

(c) a first side section having a width substantially equal to said width of said bow section and including a first end releasably connected to said first connector element of said bow section, said first side section having a upper segment engagable with the deck;

(d) means for connecting said first side section to the deck rail;

(e) a second side section having a first end releasably connected to said second connector element of said bow section, said second side section having an upper segment engagable with the deck;

(f) means for connecting said second side section to the deck rail;

(g) a first stern section having first and second ends, said first end being releasably connected to said first side section and said second end having a plurality of fingers each said finger having a connector element;

(h) a second stern section having first and second ends, said first end being releasably connected to said second side section and said second end having a plurality of, fingers each of said fingers having a connector element; and (i) means for connecting said first and second stern sections to the deck of the watercraft.

13. A covering as defined in claim 13 in which said means for connecting said stern sections to the deck comprise suction cup assemblies removably connected to the deck.

14. A covering as defined in claim 12 in which said bow section further includes means for urging said section into close engagement with the side walls of the watercraft.

15. A covering as defined in claim 12 in which said bow sections and each of said side sections is provided with cushioning means for cushioning forces imparted to the covering upon the watercraft engaging another object.

16. A covering as defined in claim 12 in which said bow section, said side sections and said stern sections are constructed from a stretchable material.

* * * * *